US006547596B1

(12) United States Patent
Pavlovic et al.

(10) Patent No.: US 6,547,596 B1
(45) Date of Patent: Apr. 15, 2003

(54) FILTERED ELECTRICAL CONNECTOR WITH FERRITE MEMBER AND COIL

(75) Inventors: Slobodan Pavlovic, Canton, MI (US); Gerhard Drescher, St. Clair Shores, MI (US)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 09/580,592

(22) Filed: May 30, 2000

(51) Int. Cl.[7] ..... H01R 13/66
(52) U.S. Cl. ..... 439/620; 336/100
(58) Field of Search ..... 439/620, 352, 439/595, 466, 15, 135, 746, 747, 741, 733, 749, 676; 336/100, 205, 198, 170, 65, 83, 181, 96

(56) References Cited

U.S. PATENT DOCUMENTS

| | | | | | |
|---|---|---|---|---|---|
| 3,710,187 | A | * | 1/1973 | Harnden, Jr. | 317/15 |
| 4,271,453 | A | | 6/1981 | Yajima et al. | 361/248 |
| 4,374,605 | A | | 2/1983 | Bratt | 339/143 |
| 4,747,789 | A | | 5/1988 | Gliha | 439/620 |
| 4,845,393 | A | | 7/1989 | Burgess et al. | 310/51 |
| 5,213,552 | A | | 5/1993 | Kojima | 439/620 |
| 5,231,322 | A | * | 7/1993 | Richards et al. | 310/51 |
| 5,241,910 | A | | 9/1993 | Cunningham et al. | 102/530 |
| 5,489,220 | A | | 2/1996 | Hanna et al. | 439/620 |
| 5,586,902 | A | | 12/1996 | Hopf et al. | 439/352 |
| RE36,427 | E | * | 12/1999 | Gioutsos | 280/735 |
| 6,152,775 | A | * | 11/2000 | Pavlovic | 439/620 |

FOREIGN PATENT DOCUMENTS

| | | | | |
|---|---|---|---|---|
| DE | 43 10 369 | | 10/1994 | |
| EP | 0 512 582 | | 11/1992 | |
| EP | 1 009 069 | | 6/2000 | |
| EP | 1 009 070 | | 6/2000 | |
| EP | 1-164665 | A1 * | 11/2001 | 13/719 |
| GB | 2276778 | | 10/1994 | |
| WO | WO 99/08062 | | 2/1999 | |

* cited by examiner

*Primary Examiner*—Renee Luebke
*Assistant Examiner*—Phuongchi Nguyen
(74) *Attorney, Agent, or Firm*—Blank Rome LLP

(57) ABSTRACT

The design of the present invention compiles EMI protection of two formerly separated filtering devices (coil and ferrite beads) in one optimal packaging. It consists of a coil wound around a cylindrical tubular ferrite bead and welded at one end to the terminal receptacle fed through the ferrite bead. The signal is routed through the coil and then through the ferrite bead providing added filtering effect. The design provides further performance improvement and significant reduction of the packaging size. The filtering system of the present invention has a superior performance and efficiency in the 100 to 300 MHz range. The present invention provides minimum packaging size for required electrical and mechanical performance. The filter consisting of a coil and a ferrite bead is packaged in the contact portion (or nozzle area) of the connector, eliminating the necessity of packaging space in the connector housing. Providing only one locking hook improves side-to-side packaging performance for serviceable connectors and provides more reliable locking.

20 Claims, 7 Drawing Sheets

FILTERED ELECTRICAL CONNECTOR WITH FERRITE MEMBER AND COIL

BACKGROUND OF THE INVENTION

1. Field of the Invention

The present invention relates to electrical connectors and, more particularly, to filtered electrical connectors providing EMI protection.

2. Prior Art

U.S. Pat. No. 5,489,220 discloses a filter connector with a ferrite barrel for two electrical contacts. Similarly, U.S. Pat. No. 5,241,910 and corresponding European Patent Application No. EP 0 512 682 disclose a connector including a ferrite bead having two holes in spaced relation with an electric terminal disposed in each hole for making electrical contact with an associated one of the protruding pins of a pin type electric squib. This connector may be an angled connector. Moreover, U.S. Pat. No. 5,213,522 discloses a filtered connector with a multipiece ferrite block. A problem with these types of ferrite blocks or beads is that they must be made of electrically non-conductive ferrite oxide to prevent short-circuiting of the contacts and, therefore, cannot filter lower frequencies (about 1–150 MHz) without increasing length of the ferrite block and thereby increasing the size of the connector. For a filtered connector intended to be used in a small space, such as an air bag connector, increasing the size of the connector is not desired. If an electrically conductive ferrite oxide material needed to be used for lower frequency attenuation, such as about 1–150 MHz, electrical insulators would need to be added between the contacts and the ferrite block.

DE 43 10 369 discloses an angled air bag connector including an RF coil for EMI filtering. A connector of this type is illustrated in FIGS. 8 and 9 of the drawings. The connector 100 is an angled connector including a main portion 101 comprising conductor terminals 102, 103 for connecting respective input conductors or lead wires 104, 105, and a contact portion 106 comprising connector terminals 107, 108 for receiving contact pins of a mating connector of the air bag assembly (not shown). The RF coil 109 is connected in a series circuit with one of the input conductors or lead wires 104 to one of the connector terminals 108. The RF coil 109 may be wrapped around a cylindrical ferrite body 110. The RF coil 109 is disposed in a transverse direction with respect to the connector terminals 107, 108 and conductor terminals 102, 103 adjacent to the 90° bend of the angled connector. In this way, the main portion 101 of the connector extends beyond the contact portion 106 forming a coil portion 111 so that the connector may be considered as being generally T-shaped. Thus, the RF coil, and the ferrite body, if any, increase the size of the connector in longitudinal direction.

Moreover, prior art air bag connectors comprise two locking latches on opposite sides of the connector so as to lock the connector to the socket provided on the igniter of the air bag module. Having the locking latches provided on the sides of the connector inhibits close side-by-side packaging of two or more connectors.

SUMMARY OF THE INVENTION

According to one aspect of the present invention, there is provided an EMI filter connector device comprising a first contact element, a tubular ferrite bead surrounding said first contact element, and a coil wound around said ferrite bead.

Preferably, the coil has a first coil terminal and a second coil terminal, and said connector device further comprises a first conductor connecting portion, wherein one of said first and second coil terminals is connected to said first contact element, and wherein the other of said first and second coil terminals is connected to said first conductor connecting portion.

Preferably, the connector comprises a second contact element and a second conductor connecting portion wherein said second contact element is connected to said second conductor connecting portion. In a preferred embodiment said first and second contact elements are female contacts.

It is preferred that the connector of the present invention comprises a housing having a main portion and a contact portion, said contact portion being adapted to be inserted into an associated socket and extending at about 90° with respect to said main portion so as to provide an angled connector wherein said contact elements, said ferrite bead, and said coil are disposed in said contact portion of said housing.

The new EMI filtering connector of the present invention provides connector miniaturization with improved performance over an extended frequency range as compared to coil only.

The design of the present invention compiles EMI protection of two formerly separated filtering devices (coil and ferrite beads) in one optimal packaging. It consists of a coil wound around a cylindrical tubular ferrite bead and welded at one end to the terminal receptacle fed through the ferrite bead. The signal is routed through the coil and then through the ferrite bead providing added filtering effect. The design provides further performance improvement and significant reduction of the packaging size. The filtering system of the present invention comprising one coil and ferrite bead EMI protective device has a superior performance and efficiency in the 100 to 300 MHz range and at least 20 dB attenuation over a frequency range from 1 MHz to 1.5 GHz with appropriate selection of the ferrite material. Performance can be tailored by adding more filtering devices par circuit (combinations of coil and ferrite bead filtering units and ferrite bead filtering units).

This design provides minimum packaging size for required electrical and mechanical performance. The filter consisting of a coil and a ferrite bead is packaged in the contact portion (or nozzle area) of the connector, eliminating the necessity of packaging space in the connector housing.

According to another aspect of the invention, a connector device comprises a housing having a main portion and a contact portion, said contact portion being adapted to be inserted into an associated socket and extending at about 90° with respect to said main portion so as to provide an angled connector wherein said main portion of said connector has a rear end where conductors are fed into the connector and a front end near said contact portion, wherein a single locking means is provided at the front end of main portion.

According to still another aspect of the invention, an EMI filter connector device comprises a housing having a main portion and a contact portion, said contact portion being adapted to be inserted into an associated socket and extending at about 90° with respect to said main portion so as to provide an angled connector, first and second contact elements disposed in said contact portion of said housing, a tubular ferrite bead disposed in said contact portion and surrounding said first contact element, a coil wound around said ferrite bead and having a first coil terminal and a second coil terminal, and first and second conductor connecting portions disposed in said main portion of said housing, wherein one of said first and second coil terminals is connected to said first contact element, and wherein the other of said first and second coil terminals is connected to said first conductor connecting portion, wherein said second contact element is connected to said second conductor connecting portion, wherein said main portion of said connector has a rear end where conductors are fed into the connector and a front end near said contact portion, wherein a single locking means is provided at the front end of main portion. Preferably, said single locking means is a locking hook.

Providing only one locking hook or locking leg improves side-to-side packaging performance for serviceable connectors and provides more reliable locking. The housing (nozzle) is premolded and the filter and terminal/wire assembly is preassembled. Low pressure over-molding is used to enclose the components in the housing. Side-to-side packaging is an important point e.g. for dual stage air bag systems.

The present invention provides a miniaturized connector that is about three times smaller than the current DC air bag connectors with side-to-side packaging.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
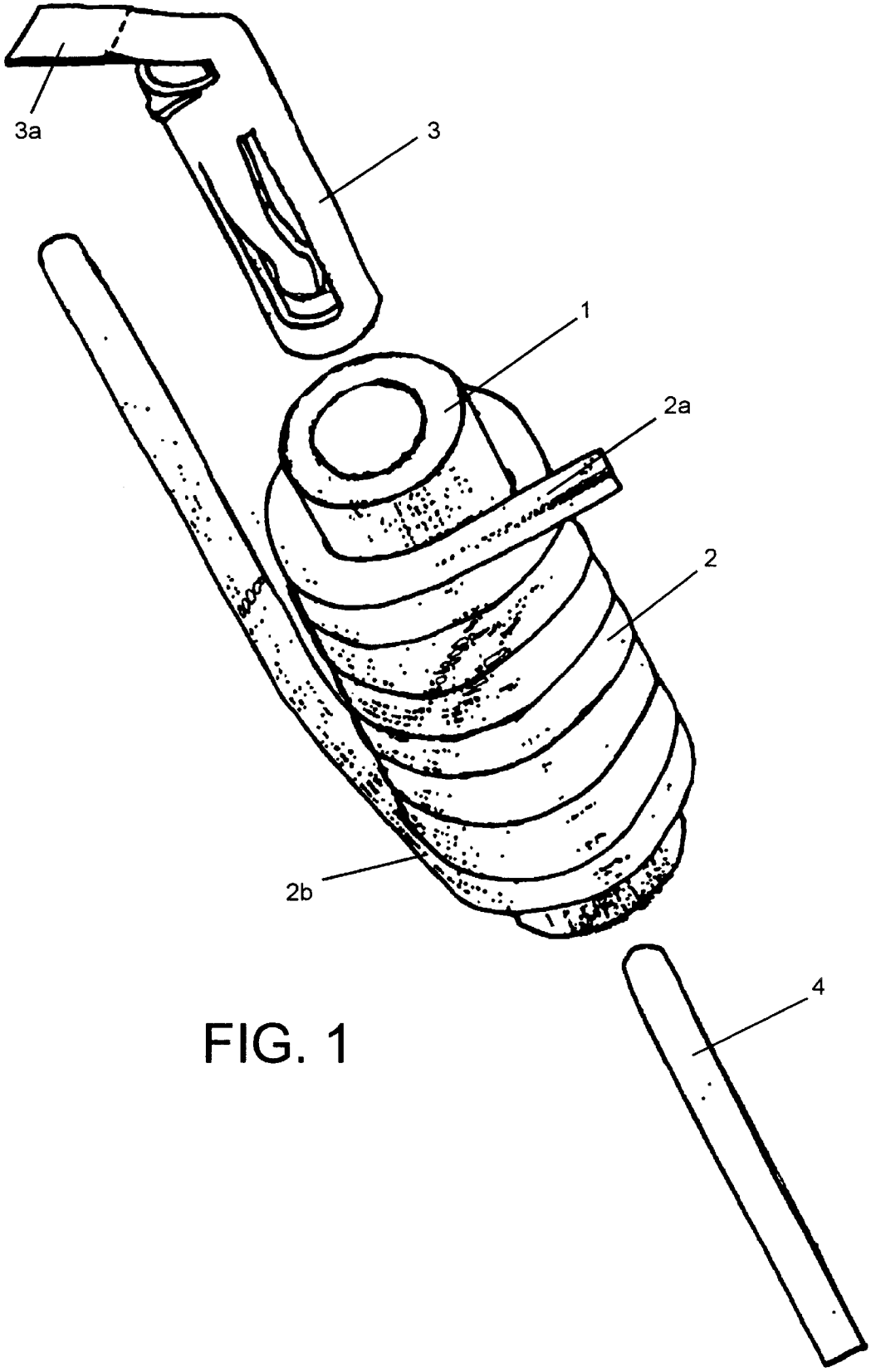
FIG. 1 is an exploded view of the EMI protective system included in an electrical connector of the present invention.

Referring to FIG. 1, there is shown an exploded view of the EMI protective system included in an electrical incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 2:
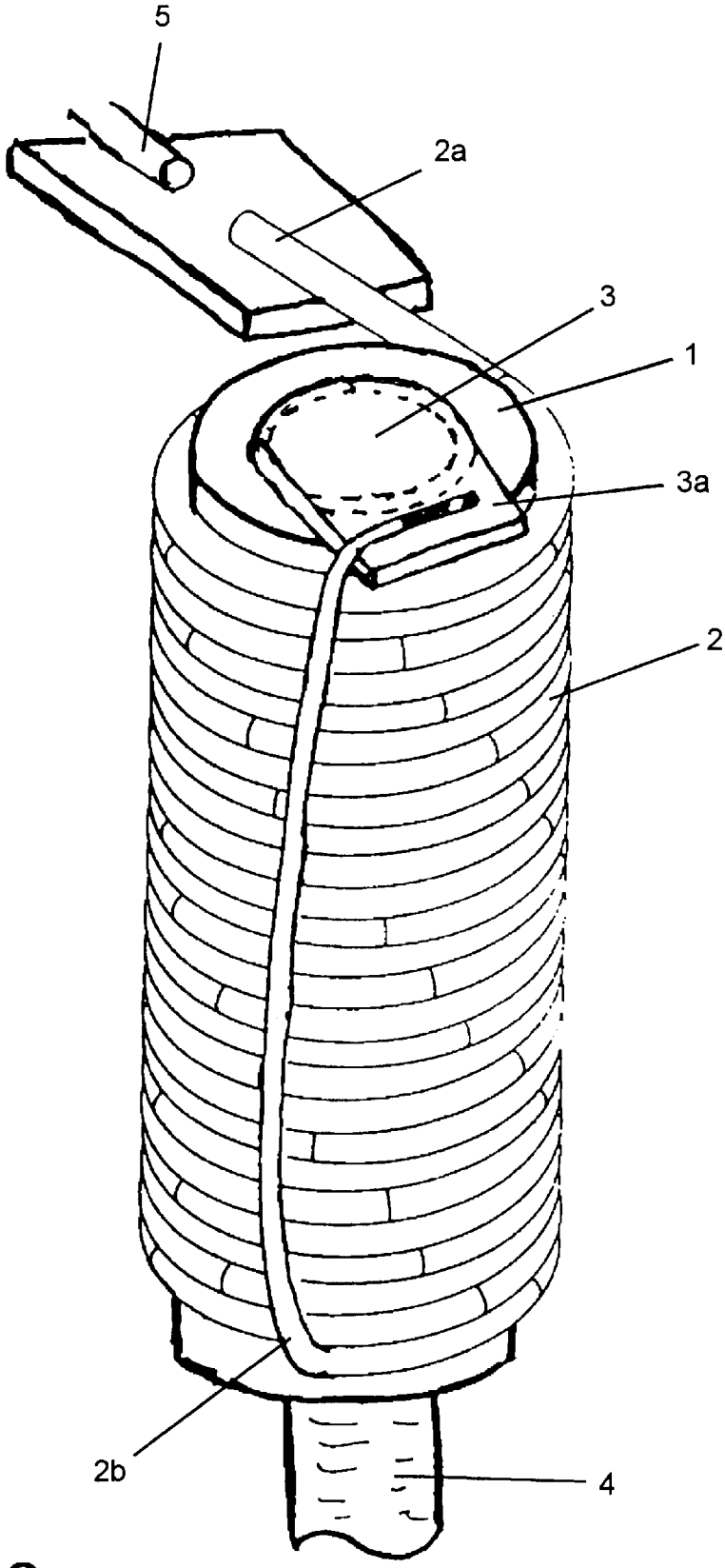
FIG. 2 is perspective view of the EMI protective system shown in FIG. 1 in an assembled condition.

The EMI protective system may be used in a connector connecting electrical conductors with an air bag gas generator. However, the connector could be used to connect conductors with other devices. Referring also to FIG. 2, the EMI protective system generally comprises a ferrite bead or hood 1 and a coil 2 wound around the ferrite bead 1.

Preferably, the ferrite bead 1 is comprised of metal powder which is pressed into a mold and sintered into shape. Alternative manufacturing such as extrusion could also be used.

The ferrite bead 1 has a generally tubular cylindrical shape and forms a sleeve for accommodating a female contact element 3 which is commonly comprised in the electrical connector. In a preferred embodiment, the ferrite bead 1 has a tubular shape with an inner diameter of about 1.5 mm and an outer diameter of about 2.5 mm. Other sizes are available for different sizes of the contact element.

At least one and normally two contact pins or male contacts 4 are commonly associated with the igniter or squib (not shown) and project therefrom. For the sake of simplicity, only one such contact pin is shown in FIGS. 1 and 2. In the assembled condition, as shown in FIG. 2, the contact pin 4 is inserted into the female contact 3 of the connector. Both the contact pin 4 and the female contact 3 extend into the ferrite bead 1 such that contact between the female and the male contacts is made within the ferrite bead 1. Preferably, there is a friction fit between the female contact 3 and the ferrite bead 1 when the contact 3 is inserted into the ferrite bead 1. The ferrite bead 1 may be made of non-conductive ferrite or, if particular filter properties of conductive ferrite are preferred, it may be made of conductive ferrite.

The coil 2 has two terminals 2*a* and 2*b*. In a preferred embodiment, terminal 2*a* at the end of the coil 2 adjacent to the female contact 3 is used for signal input, i.e. it is connected to a conductor 5 to be connected to the contact pin 4, such as a conductor providing a firing or deployment signal for an associated air bag. The terminal 2*b* at the opposite end of the coil 2 adjacent to the contact pin 4 is electrically connected to a portion or tab 3*a* of the female contact 3 by welding, soldering, or other suitable means. Of course, the terminals 2*a*, 2*b* of the coil 2 may be connected in the opposite sense, i.e. vice versa to the above configuration.

Figure 3:
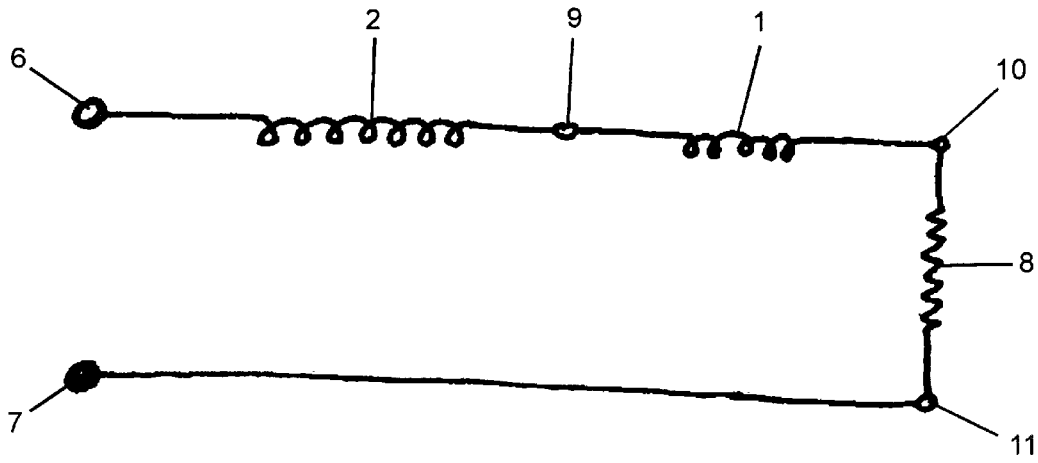
FIG. 3 is a circuit diagram of the electric scheme including the electrical connector of the present invention and an associated igniter or squib.

FIG. 3 is a circuit diagram of the electric scheme including the electrical connector of the present invention and an associated igniter or squib. The circuit diagram shows a series circuit of signal input 6, e.g. from vehicle electronics providing a firing or deployment signal for the associated air bag, to signal output 7, e.g. connected to ground. Signal input 6 and signal output 7 may be considered as two conductors or wires in a lead or cable from vehicle electronics to the air bag connector. The series circuit comprises the coil 2, the ferrite bead 1, and a resistor 8 inside the igniter, with reference numeral 9 denoting the welding-point of terminal 2*b* to the female contact portion 3*a*, and reference numerals 10 and 11 denoting the contact points of the female contact 3 with contact pin 4, and the contact point of another contact pin (not shown in FIGS. 1 and 2) with another contact pin (not shown in FIGS. 1 and 2), respectively. The resistor 8 inside the igniter is usually a wire which heated by a deployment signal so as to cause ignition of the igniter or squib.

Figure 4:
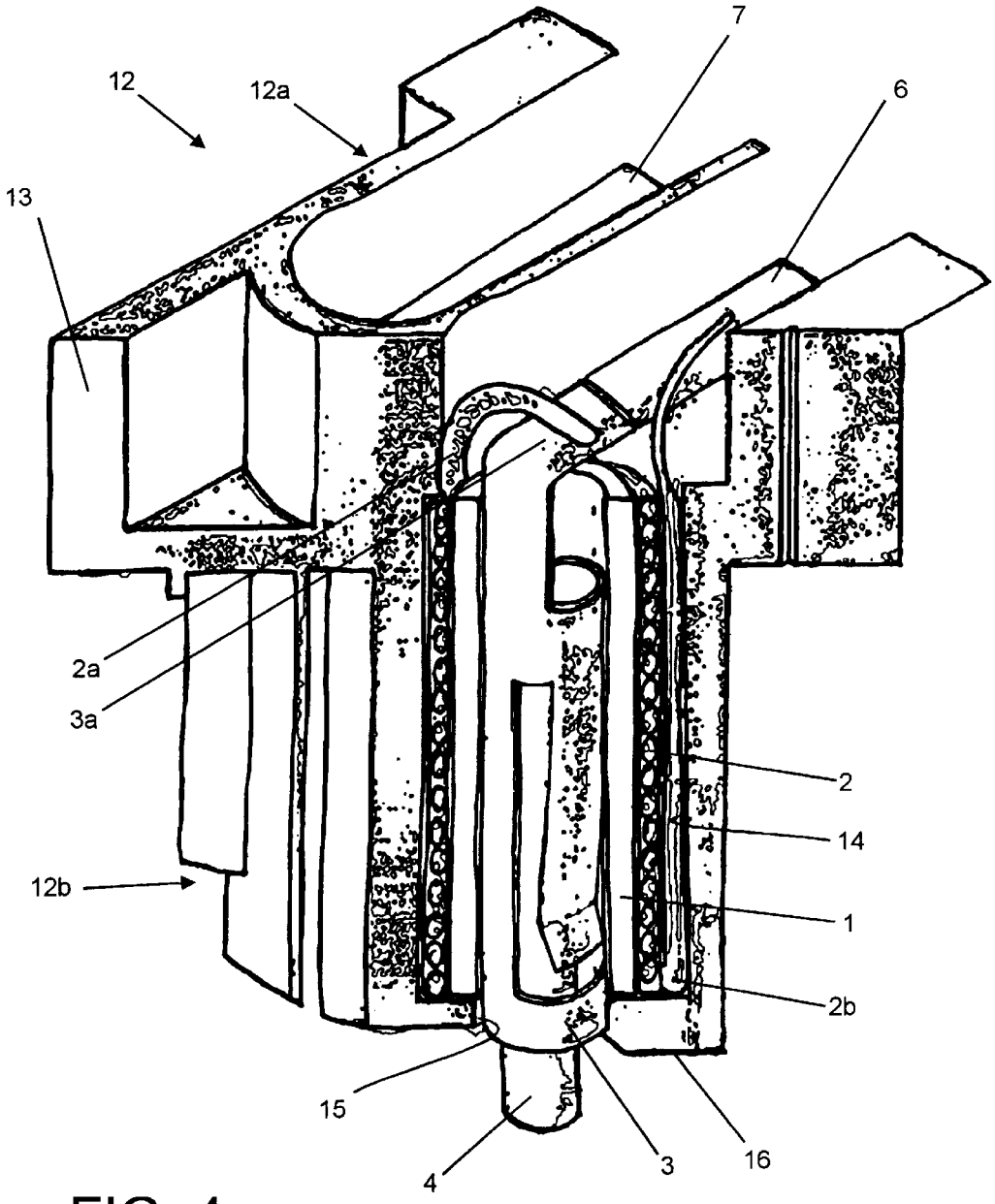
FIG. 4 is a partially cut perspective view of an embodiment of an electrical connector according to the present invention.

FIG. 4 shows an embodiment of an electrical connector 12 according to the present invention wherein coil 2 is connected in an opposite sense to that in the embodiments of FIGS. 1 and 2. The connector 12 is an angled connector and comprises generally two portions, a conductor portion or main portion 12*a* and a contact portion or nozzle 12*b*.

The electrical components of the connector 12 are accommodated in a housing 13. The housing 13 may be made of dielectric plastic and comprises two separate receiving areas 14, and two holes 15 through a bottom face 16 of the housing into the receiving areas 14. The contact portion 12*b* is adapted to be plugged e.g. into a socket of an igniter for a gas generator (not shown).

The connector 12 preferably comprises two electrical contacts, each comprising a female contact and a connection area for connection to electrical conductors. Preferably, the female contacts are comprised of stamped and formed sheet metal. The female contacts, one of which is shown at 3, each have two spring contact arms for making safe contact with a contact pin.

In this embodiment the connector 12 has a 90° bend for a right angle connector. However, the connector 12 could be straight for an in-line connector.

The socket of the igniter (not shown) has two male pin contacts (only one of which is shown at 4 in FIGS. 1, 2, and 4) at a fixed spacing relative to each other that are received in the two female contacts through the holes 15 in the housing 13. Thus, the connector is able to electrically connect the contact pins to the conductors.

Figure 5:
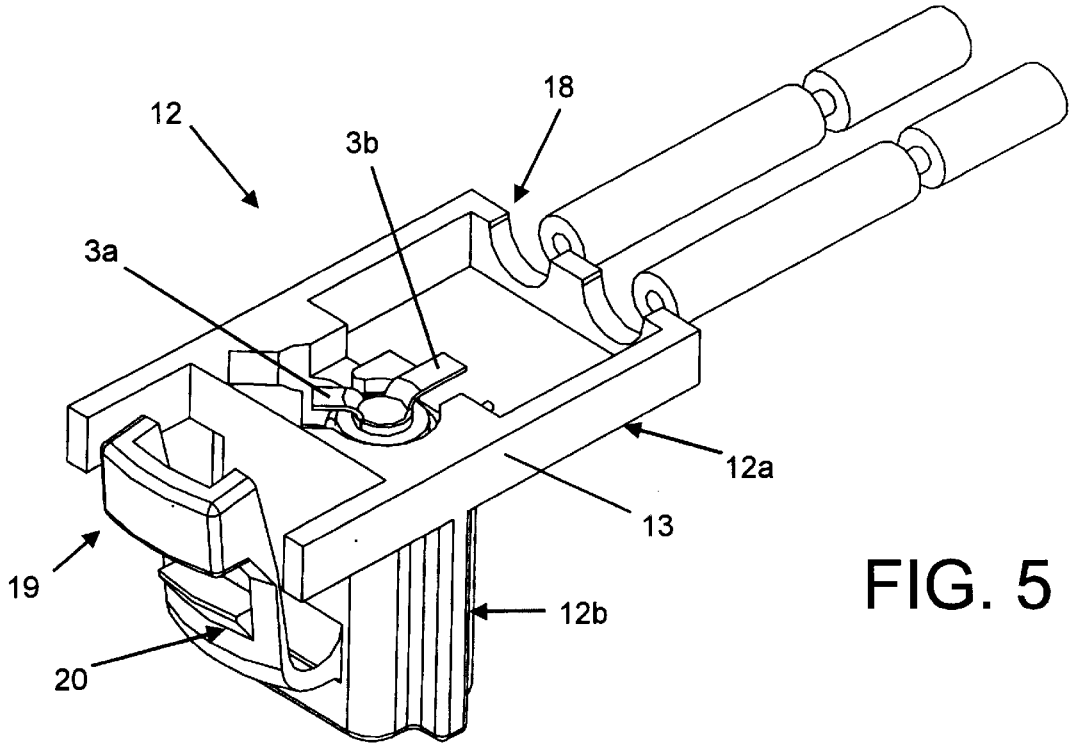
FIG. 5 is a perspective view of another embodiment of an electrical connector according to the present invention with the cover of the housing removed.

As may be seen in FIG. 5, a preferred alternative embodiment of the contact element 3 may comprise two tabs 3*a*, 3*b* wherein one (3*a*) of said tabs is used for contacting a coil terminal if a coil is used with this contact element, and the other tab 3*b* being used for connection with a conductor if no coil is used with this contact element. In this way, only one type of contact element is required for both filtered and unfiltered contacts.

Figure 6:
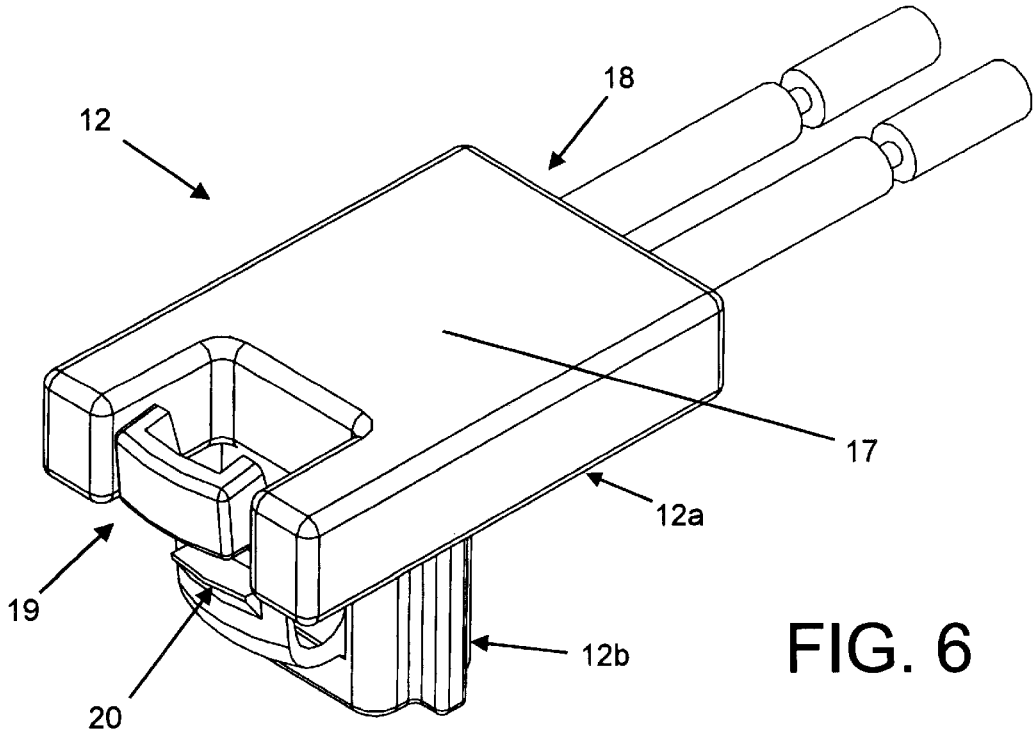
FIG. 6 is a perspective view of the electrical connector of FIG. 5 including the cover of the housing.

FIGS. 5 and 6 illustrate another important feature of the present invention. FIG. 5 shows another embodiment of an electrical connector 12 according to the present invention with a cover of the housing 13 removed, while FIG. 6 is a perspective view of the electrical connector of FIG. 5 including a cover 17. The cover 17 may be over-molded and also provides strain relief for the conductors. In an alternate embodiment the cover 17 need not be over-molded.

The main portion 12*a* of the connector 12 has a rear end 18 where the conductors are fed into the connector and a front end 19 near the contact portion 12*b*. By placing the filtering components (ferrite bead 1 and coil 2) in the contact portion 12*b* of the connector 12 (see above), it is possible to provide a single locking or latching hook 20 at the front end 19 of an angled connector.

Figure 7:
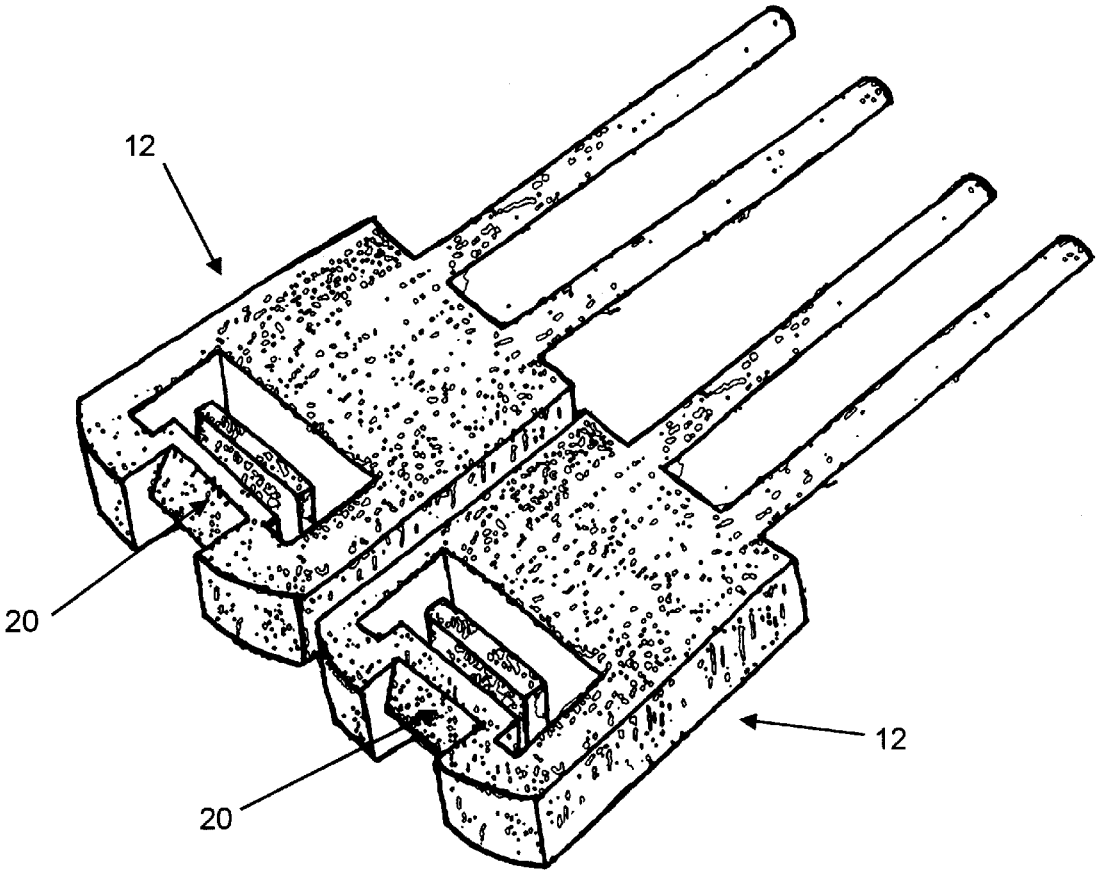
FIG. 7 is a perspective view of a side-by-side arrangement of two electrical connectors in accordance with the present invention.
Figure 8:
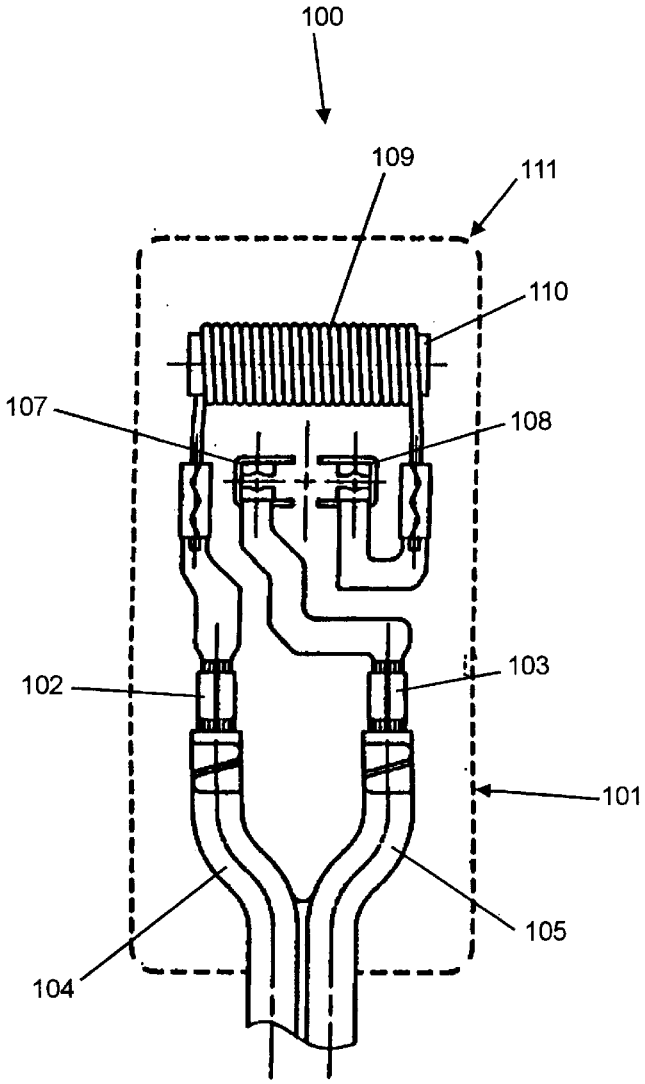
FIG. 8 PRIOR ART
FIG. 8 is a schematic top plan view of a prior art connector.
Figure 9:
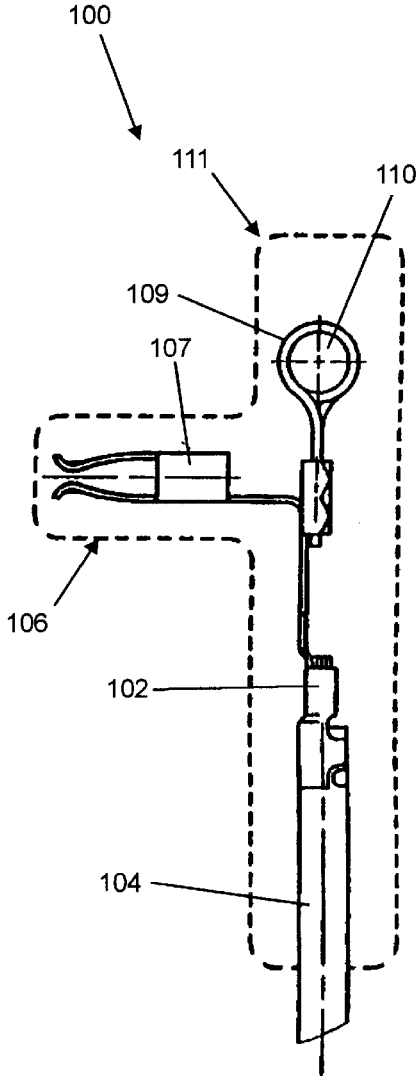
FIG. 9 PRIOR ART
FIG. 9 is a schematic side view of the prior art connector shown in FIG. 8.

A plurality of such connectors can thus be placed in close proximity next to each other in a side-by-side relationship, thereby requiring less space than prior art designs while providing reliable locking of the connector to an associated socket (see FIG. 7).

In FIG. 7, an alternate embodiment of a connector 12 with a different single locking hook 20 in the frontal region of the connector is shown. It is to be understood that instead of a locking hook other locking or latching means could be used in the frontal region of the connector.

According to the present invention, cost and weight and size of the connector can be minimized. The present invention allows two different filter components to be used in the same connector, namely a ferrite bead and a coil for a better or wider range of filtering. The present invention provides a means to reduce the size of the connector while maintaining good filtering by providing a ferrite bead around one contact and by providing a coil would around the ferrite bead wherein said filtering components are disposed in the contact portion or nozzle of the connector. This design also enables the use of a single locking hook in the frontal region of the connector.

It should be understood that the foregoing description is only illustrative of the invention. Various alternatives and modifications can be devised by those skilled in the art without departing from the invention. For example, the location of the female contacts and the contact pins could be reversed such that the contact pins are comprised in the connector whereas the female contacts are disposed in an associated socket. Further, for example, based on specific filtering requirements, different combination of filtering units can be used as follows: one coil and ferrite bead EMI protective device per circuit; two coil and ferrite bead EMI protective devices per circuit; one coil and ferrite bead EMI protective device and one ferrite bead EMI protective device per circuit; each with different combinations of ferrite materials and geometries. Accordingly, the present invention is intended to embrace all such alternatives, modifications and variances which fall within the scope of the appended claims.

What is claimed is:

1. An EMI filter connector device connecting electrical conductors with an air bag gas generator, comprising:

a first conductor connecting portion, a first contact element for contacting an associated contact element of said air bag gas generator;

a tubular ferrite bead forming a coil core around said first contact element;

a coil having a first coil terminal and a second coil terminal wound around said ferrite bead wherein one of said coil terminals is connected to said first contact element and the other of said coil terminals is connected to said first conductor connecting portion, such that a signal from said first conductor connecting portion is routed through the coil to the first contact element and through the coil core.

2. A device as in claim 1, further comprising a second contact element and a second conductor connecting portion wherein said second contact element is connected to said second conductor connecting portion.

3. A device as in claim 2 wherein said first and second contact elements are female contacts.

4. A device as in claim 2 wherein said first and second contact elements each comprise two tabs wherein one of said tabs is used for contacting a coil terminal if a coil is used with this contact element, and the other tab being used for connection with a conductor if no coil is used with this contact element.

5. A device as in claim 3, further comprising a housing having a main portion and a contact portion, said contact portion being adapted to be inserted into an associated socket and extending at about 90° with respect to said main portion so as to provide an angled connector wherein said contact elements, said ferrite bead, and said coil are disposed in said contact portion of said housing.

6. A device as in claim 5 wherein said main portion of said connector has a rear end where conductors are fed into the connector and a front end near said contact portion, wherein a single locking or latching means is provided at the front end of main portion.

7. A device as in claim 5 wherein said contact portion comprises two separate receiving areas for accommodating said contact elements and two holes through a bottom face of the housing into the receiving areas.

8. A device as in claim 7 further comprising a cover which is over-molded and also provides strain relief for conductors connected to said first and second conductor connector portions.

9. An EMI filter connector device comprising:

a housing having a main portion and a second contact portion, said contact portion being adapted to.be inserted into an associated socket and extending at about 90° with respect to said main portion so as to provide an angled connector;

first and second contact elements disposed in said contact portion of said housing;

a tubular ferrite bead forming a coil core disposed in said contact portion and surrounding said first contact element;

a coil wound around said ferrite bead and having a first coil terminal and a second coil terminal; and first and second conductor connecting portions disposed in said main portion of said housing, wherein one of said first and second coil terminals is connected to said contact element, and wherein the other of said first and second coil terminals is connected to said first conductor connecting portion such that a signal from said first conductor connecting portion is routed through the coil to the first contact element and through the coil core, wherein said second contact element is connected to said second conductor connecting portion;

wherein said main portion of said connector has a rear end where conductors are fed into the connector and a front end near said contact portion, wherein a single locking means is provided at the front end of main portion.

10. A device as in claim 9 wherein said single locking means is a locking hook.

11. A device as in claim 9 wherein said first and second contact elements are female contacts.

12. A device as in claim 9 wherein said ferrite bead is comprised of metal powder which is pressed into a mold and sintered into shape.

13. A device as in claim 9 wherein said ferrite bead has a tubular shape with an inner diameter of about 1.5 mm and an outer diameter of about 2.5 mm.

14. A device as in claim 9 wherein said ferrite bead is made of conductive ferrite.

15. A device as in claim 9 wherein said contact portion comprises two separate receiving areas for accommodating said contact elements and two holes through a bottom face of the housing into the receiving areas.

16. A device as in claim 9 further comprising a cover which is over-molded and also provides strain relief for conductors connected to said first and second conductor connector portions.

17. A device as in any of claims 1, 2, 9 or 10 wherein said ferrite bead is of a regular cylindrical tubular shape having constant inner and outer diameters throughout the axial length of the ferrite bead.

18. A device as in any of claims 1, 2, 9 or 10 wherein said ferrite bead has, at both axial ends of the ferrite bead, cylindrical portions having a larger outer diameter that a central cylindrical portion.

19. A device as in any of claims 1, 2, 9 or 10 wherein said ferrite bead has generally two portions of different outer diameter.

20. A device as in any of claims 1, 2, 9 or 10 wherein the inner diameter of the ferrite bead is constant throughout the axial length of the ferrite bead.

* * * * *